US007140472B2

(12) United States Patent
Tyni et al.

(10) Patent No.: US 7,140,472 B2
(45) Date of Patent: Nov. 28, 2006

(54) GENETIC ALLOCATION METHOD FOR AN ELEVATOR GROUP

(75) Inventors: Tapio Tyni, Hyvinkää (FI); Jari Ylinen, Hyvinkää (FI); Mika Matela, Lahti (FI); Toni Rintala, Järvenpää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/127,269

(22) Filed: May 12, 2005

(65) Prior Publication Data

US 2005/0269164 A1 Dec. 8, 2005

Related U.S. Application Data

(63) Continuation of application No. PCT/FI03/00863, filed on Nov. 13, 2003.

(30) Foreign Application Priority Data

Nov. 29, 2002 (FI) ..... 20022105

(51) Int. Cl.
*B66B 1/20* (2006.01)

(52) U.S. Cl. ..... 187/382; 187/247

(58) Field of Classification Search ..... 187/380–388, 187/247, 248, 902; 706/13, 21, 902, 903, 706/910

See application file for complete search history.

(56) References Cited

U.S. PATENT DOCUMENTS 5,780,789 A 7/1998 Tsuji
5,907,137 A * 5/1999 Tyni et al. ..... 187/382
5,932,852 A 8/1999 Tyni et al.
6,776,264 B1 * 8/2004 Tyni et al. ..... 187/382
6,913,117 B1 * 7/2005 Tyni et al. ..... 187/382
2005/0029054 A1 * 2/2005 Matela ..... 187/382

FOREIGN PATENT DOCUMENTS

EP 0 897 891 A1 2/1999
WO WO-01/65231 A2 9/2001

* cited by examiner

*Primary Examiner*—Jonathan Salata
(74) *Attorney, Agent, or Firm*—Birch, Stewart, Kolasch & Birch, LLP

(57) ABSTRACT

A genetic allocation method in an elevator group for allocating a landing call to one of several elevator cars in the elevator group, the cars moving and stopping within the area of several different floors. The elevator travel routes are encoded into alternative chromosomes. Using genetic methods, alternative chromosomes are developed and the best chromosome is selected. The elevator group is controlled in accordance with the best chromosome. The floors served by the elevator group are divided into a first group and a second group. On the floors of the first group, landing calls are given as passenger-specific destination calls. On the floors of the second group, landing calls are given as floor-specific up/down calls. When the destination calls and up/down calls are encoded into the same chromosome, the best chromosome represents an allocation decision, in which the gene values indicate which elevator car is to serve each passenger and each up/down call.

10 Claims, 2 Drawing Sheets

GENETIC ALLOCATION METHOD FOR AN ELEVATOR GROUP

BACKGROUND OF THE INVENTION

1. Field of the Invention

The present invention relates to an allocation method for controlling elevator groups.

2. Brief Description of the Related Art

Finnish patent application 951925 discloses a genetic method for allocating landing calls in an elevator group by forming a plurality of allocation options, each of which contains call data and elevator data for each landing call, said data together defining the elevator which is to serve each landing call. After this, the value of a cost function is computed for each allocation option and one or more allocation options are altered in respect of at least one data item, whereupon the values of the cost functions of the new allocation options are computed. On the basis of the cost functions, the best allocation option is selected and the currently active landing calls are allocated accordingly to the elevators of the elevator group.

In such a method, landing calls are given in such manner that the first person who comes to the floor inputs a landing call, which determines the desired traveling direction. Thus other passengers will not have to press a call button, if they are going in the same direction. This method is particularly effective in lunch hour-type traffic, mixed traffic and outgoing traffic, whereas intensive incoming traffic causes problems and congestion when this type of control method is used.

Finnish patent application 20000502 discloses a genetic method for the allocation of passengers to elevators, wherein each passenger gives his/her destination floor via a call input device, the starting floor and destination floor of the passenger being thus known. The passenger is allocated to an elevator car to serve him/her by a genetic allocation method, wherein the elevator routes are encoded into alternative chromosomes, the required data regarding the passenger and the elevator car being stored in a gene of the chromosome. After this, utilizing genetic methods, alternative chromosomes are developed and the best one among these is selected. In this way, the passengers indicated by the best chromosome are guided to the elevator cars represented by this chromosome, and the elevator cars indicated by the best chromosome are assigned to serve the passengers stored on the chromosome.

In such a method, the landing calls are issued as personal destination calls so that each person arriving at the landing gives his/her destination floor. Immediately after the group control system has made its control decision, the person is given information as to which elevator car is going to serve him/her. This method is particularly effective during heavy incoming traffic, whereas in lunch hour-type traffic, mixed traffic and outgoing traffic this type of control method may cause problems and congestion.

BRIEF SUMMARY OF THE INVENTION

The object of the present invention is to overcome some of the drawbacks mentioned above. A specific object of the invention is to combine the good properties of the above-mentioned genetic allocation methods while simultaneously eliminating the drawbacks observed in them.

The basic starting point of the allocation method of the invention is that it must be possible that, in the same elevator group, both passenger-specific destination calls and floor-specific up/down calls are in use and also simultaneously valid and the control method must be able to make an allocation decision by taking into account both types of calls at the same time.

The genetic allocation method of the invention is used in an elevator group for allocating a landing call to one of the several elevator cars in the elevator group, which move and stop within an area comprising a plurality of different floors. In the method, the traveling routes of the elevator cars are encoded into alternative chromosomes, alternative chromosomes are developed using genetic methods and the best one among these is selected, and the elevator group is controlled in accordance with the best chromosome. According to the invention, a hybrid control method is used, wherein the floors served by the elevator group are divided into a first group and a second group in such manner that, on the floors comprised in the first group, landing calls are given as passenger-specific destination calls while on the floors comprised in the second group landing calls are given as floor-specific up/down calls. Thus, by encoding the destination calls and up/down calls into the same chromosome, the best chromosome obtained by genetic methods known in themselves represents an allocation decision in which the gene values indicate which elevator car is to serve each passenger and each up/down call.

Thus, in the hybrid control method of the invention, each passenger having issued a passenger-specific destination call is allocated separately to the elevator car to serve him/her, in other words, each passenger having issued a destination call is informed substantially immediately upon input of the call as to the elevator car which is going to serve him/her. In a corresponding manner, each floor-specific up/down call is allocated to the elevator car which is to serve it.

In an embodiment of the invention, on one or more of the floors comprised in the first group, landing calls can also be given as up/down calls in addition to destination calls. Similarly, on the floors comprised in the second group, landing calls can also be given as passenger-specific destination calls in addition to up/down calls.

In an embodiment of the invention, the selection of using a passenger-specific destination call and a floor-specific up/down call on the same floor is made on the basis of the times of the day, in other words, depending on the average traffic situation based on e.g. traffic statistics, the call mode can be changed at a given floor by adopting the call mode that is more efficient from the passenger's point of view.

In an embodiment of the invention, the selection of using a passenger-specific destination call and a floor-specific up/down call on the same floor is made in a user group-specific manner. Thus, for example, the personnel of the building and persons visiting in the building can use different elevator call modes. Another possibility is that, to reach certain floors, e.g. floors with intensive traffic, destination calls are given, whereas to reach other floors, only up/down calls determining the direction are given.

In a preferred arrangement, the floors with the most intensive traffic, such as entrance floors, restaurant floors and/or transfer floors between elevator groups and/or floors chosen by the client, are selected to be included in the first group, i.e. as floors where destination calls are given. In this way, large traffic volumes can be brought to their destinations as effectively as possible and with as few intermediate stops as possible.

In an embodiment of the invention, the allocation of an up/down call is not fixed until in a suitable later traffic situation, not immediately after the call has been input. Such delaying of the assignment of an elevator car to serve the call may be particularly advantageous at floors with heavy traffic during high traffic intensity. Thus it is possible to set an appropriate delay during which the traffic situation of the elevator group is monitored to see if a particularly advantageous car moving or located so as to suit the call in question can be found before the final allocation decision is made.

In an embodiment of the invention, up/down calls are allocated by utilizing traffic statistics, which are used to estimate the number of passengers to be transported. In this way, several up/down calls for the same direction can be served by a single car if it can be estimated from traffic statistics that the capacity of the car is sufficient. In the same way, several cars can be allocated to serve several or only a few up/down calls if can be estimated from traffic statistics that the capacity of a single car is not sufficient.

As compared with prior art, the allocation method of the invention for a hybrid elevator system has significant advantages. The allocation method of the invention allows two different elevator systems to be combined as a hybrid elevator system. Such a system requires the use of a group control method according to the invention to make it at all possible to handle the traffic in the building. The method of the invention works very effectively in all types of traffic situations from quiet to intensive traffic both during incoming traffic, outgoing traffic, interfloor traffic and different combinations of these.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
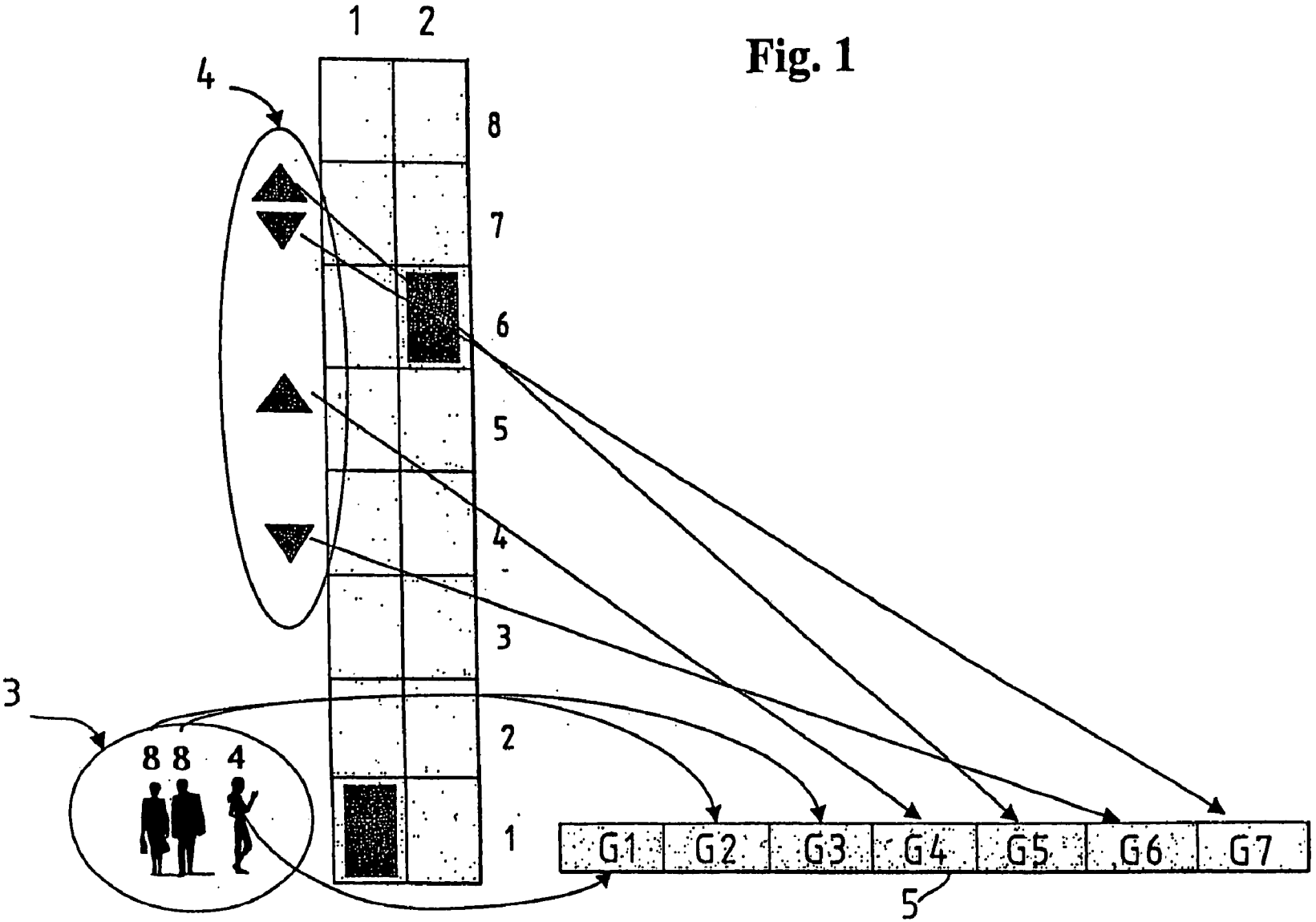
FIG. 1 is a diagrammatic example of the formation of chromosomes and their genes in the allocation method of the present invention.
Figure 2:
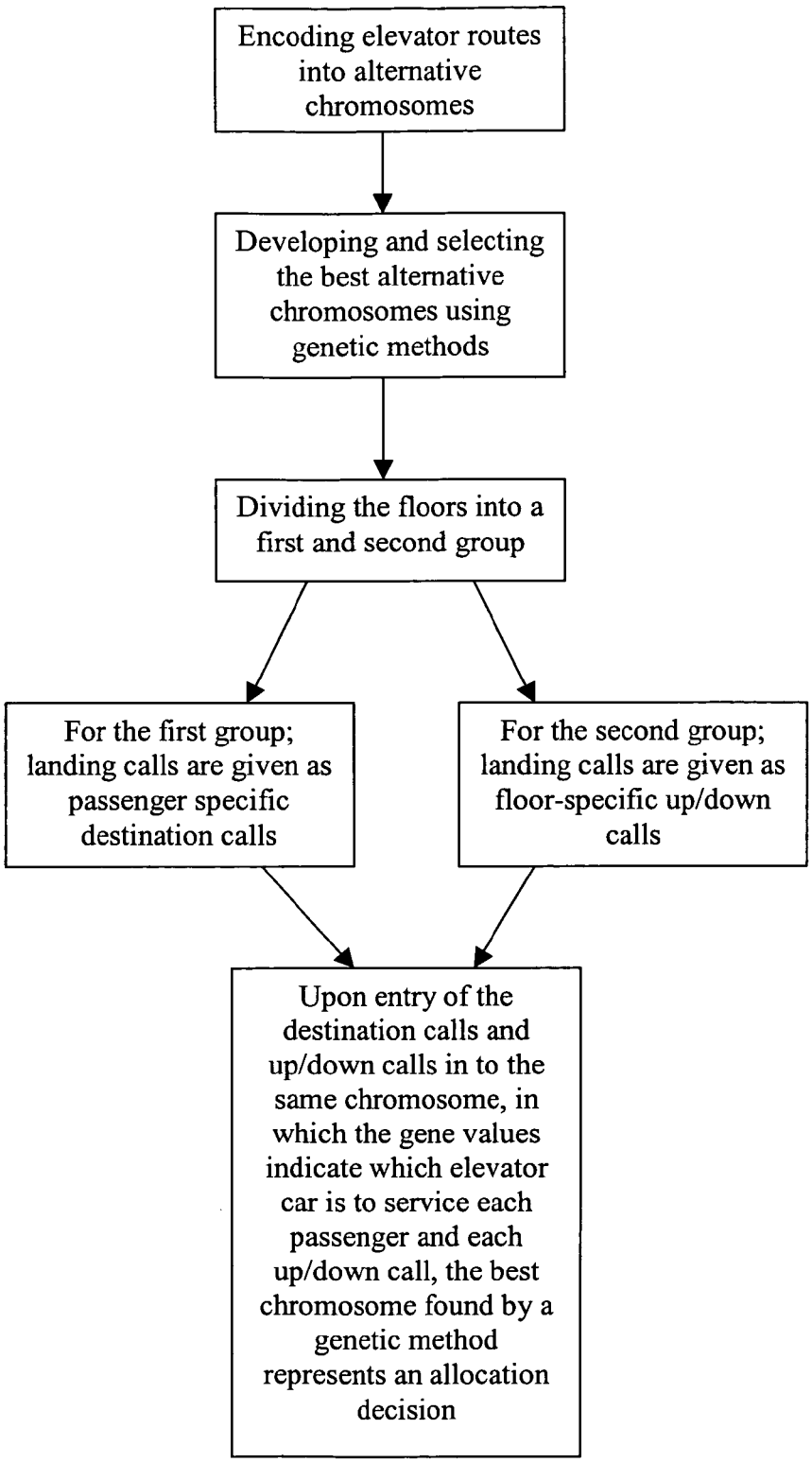
FIG. 2 is a flow-chart showing the allocation method of the present invention.

The building shown as an example in FIG. 1 has eight floors and two single-car elevators. The lowest or first floor belongs to a first group 3, in other words, landing calls on these floors are given as passenger-specific destination calls. The rest of the floors, i.e. floors 2–8 belong to a second group 4, in other words, landing calls on these floors are given as floor-specific up/down calls.

Elevator 1 is at the first floor and elevator 2 is at the sixth floor when the elevator group control system rope grooves the following calls. On the first floor, one person wants to get to the fourth floor and two persons want a ride to the eighth floor. On the fourth and seventh floors there are downward landing calls, and on the fifth and seventh floors there are upward landing calls.

According to the invention, in this traffic situation the main principle in the formation of a chromosome 5 is that the chromosome contains a separate gene corresponding to each person having issued a destination call from the first floor and value, i.e. allele of the gene determines which one of the elevator cars is to serve the passenger in question. Similarly, the chromosome contains a separate gene corresponding to each landing call, and the value or allele of the gene determines which one of the elevator cars is to serve the landing call in question. Another possibility is that the passengers on the first floor who have the same destination are treated as a single gene, i.e. as a passenger group gene.

The group control situation described above is represented by a chromosome containing seven genes. The first gene G1 corresponds to the passenger on the first floor who has given a destination call to the fourth floor. The second gene G2 and the third gene G3 correspond to the two passengers on the first floor who have issued destination calls to the eighth floor. Gene G4 corresponds to the up-call on the fifth floor, gene G5 to the up-call on the seventh floor, G6 to the down-call on the fourth floor and gene G7 to the down-call on the seventh floor.

In the example, no elevator has yet been allocated to any call or passenger, so each gene still has two possible values or alleles, i.e. elevator 1 or elevator 2. Thus, the genetic allocation method is used to find the chromosome in which the values of the genes G1–G7 are so chosen that, by controlling the elevators according to these values, the traffic situation in question can be served best or at least in a manner that meets sufficient criteria.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An allocation method in an elevator group for allocating a landing call to one of several elevator cars in the elevator group, said cars moving and stopping within the area of several different floors, by using a genetic allocation method, wherein the elevator routes are encoded into alternative chromosomes, using genetic methods, alternative chromosomes are developed and the best one among these is selected, and the elevator group is controlled in accordance with the best chromosome, wherein:

the floors served by the elevator group are divided into a first group and a second group, on the floors comprised in the first group, landing calls are given as passenger-specific destination calls, on the floors comprised in the second group, landing calls are given as floor-specific up/down calls, so that—when the destination calls and up/down calls are encoded into the same chromosome, in which the gene values indicate which elevator car is to serve each passenger and each up/down call, the best chromosome found by a genetic method represents an allocation decision.

2. The allocation method according to claim 1, wherein each passenger having issued a passenger-specific destination call is allocated to an elevator car to serve him/her.

3. The allocation method according to claim 1, wherein an elevator car is allocated to serve each up/down call.

4. The allocation method according to claim 1, wherein, on one or more of the floors comprised in the first group, landing calls are also given as up/down calls in addition to destination calls.

5. The allocation method according to claim 1, wherein, on the floors comprised in the second group, landing calls are also given as passenger-specific destination calls in addition to up/down calls.

6. The allocation method according to claim 4, wherein the selection of using a passenger-specific destination call and a floor-specific up/down call on the same floor is made on the basis of the of the day.

7. The allocation method according to claim 4, wherein the selection of using a passenger-specific destination call and a floor-specific up/down call on the same floor is made in a user group-specific manner.

8. The allocation method according to claim 1, wherein the floors with the most intensive traffic, such as entrance floors, restaurant floors and/or transfer floors between elevator groups, are selected to be included in the first group.

9. The allocation method according to claim 1, wherein the allocation of an up/down call is delayed by deciding about the elevator car to serve it in a suitable later traffic situation.

10. The allocation method according to claim 1, wherein up/down calls are allocated by utilizing traffic statistics, which are used to estimate the number of passengers to be transported.

* * * * *